US007228868B2

(12) United States Patent
Kang

(10) Patent No.: US 7,228,868 B2
(45) Date of Patent: Jun. 12, 2007

(54) FIRE HYDRANT SYSTEM

(76) Inventor: Doo Suk Kang, 201 Chunggu villa 56-163, Cheolsan 1-dong, Gwangmyeong-si, Gyeonggi-do (KR) 423-031

( * ) Notice: Subject to any disclaimer, the term of this patent is extended or adjusted under 35 U.S.C. 154(b) by 117 days.

(21) Appl. No.: 10/544,792

(22) PCT Filed: Feb. 9, 2004

(86) PCT No.: PCT/KR2004/000252

§ 371 (c)(1),
(2), (4) Date: Aug. 5, 2005

(87) PCT Pub. No.: WO2004/070123

PCT Pub. Date: Aug. 19, 2004

(65) Prior Publication Data

US 2006/0070657 A1 Apr. 6, 2006

(30) Foreign Application Priority Data

Feb. 8, 2003 (KR) ..... 20-2003-0003726
Mar. 18, 2003 (KR) ..... 20-2003-0008046
May 1, 2003 (KR) ..... 20-2003-0013653
Feb. 9, 2004 (KR) ..... 20-2004-0003180

(51) Int. Cl.
*A62C 35/68* (2006.01)

(52) U.S. Cl. ..... 137/301; 137/292; 137/293; 137/294; 137/295; 137/272

(58) Field of Classification Search ..... 137/291–295, 137/301, 272, 107
See application file for complete search history.

(56) References Cited

U.S. PATENT DOCUMENTS 1,349,062 A * 8/1920 Goldberg ..... 137/283
2,234,635 A * 3/1941 Scott ..... 137/295
6,216,792 B1 * 4/2001 Miller ..... 169/46

FOREIGN PATENT DOCUMENTS

JP 10-140623 5/1998
JP 10-140624 5/1998
KR 100306974 B1 8/2001

* cited by examiner

*Primary Examiner*—Kevin Lee
(74) *Attorney, Agent, or Firm*—Mayer & Williams PC; Stuart H. Mayer, Esq.

(57) ABSTRACT

The present invention relates to a hydrant system that is projected over the ground while being buried in the underground. The hydrant system comprises a sluice valve connected to a water-guide tube within a manhole M, the sluice valve having a first openings/shutting shaft disposed therein; a female cylinder having a drain valve that is opened when the sluice valve is locked and that is locked when the sluice valve is opened, and a bracket having a through-hole; a male cylinder having a piston for opening/shutting the bottom of the male cylinder as a piston rod is rotated in the forward or reverse direction; a rod for limiting a projection range of the male cylinder protruded against the female cylinder; a manhole cover having a sub hole through which the male cylinder passes; a second opening/shutting shaft for rotating the first opening/shutting shaft; and a universal joint, which connects the first opening/shutting and the second opening/shutting shaft.

6 Claims, 20 Drawing Sheets

FIRE HYDRANT SYSTEM

TECHNICAL FIELD

The present invention relates to a hydrant system installed everywhere in the roads, for supplying water for fire-fighting when a fire occurs.

BACKGROUND ART

The hydrant may be classified into a ground exposure type hydrant exposed on the ground, and an underground burial type hydrant buried under the ground.

In the ground exposure type hydrant, it is easy to couple the hydrant and a fire hose since the hydrant is exposed on the ground. However, there are problems that the hydrant may be damaged due to collision by a vehicle, etc. since the hydrant is exposed to external shock and may hinder traffic flow when not being used. Meanwhile, in the underground burial type hydrant, the hydrant is buried within a manhole and the top of the manhole is covered with a manhole cover. Therefore, there are advantages that this hydrant can prevent damage due to collision by a vehicle, etc. and does not prevent traffic flow. However, if the hydrant is used to in order to extinguish a fire, it is required that the manhole cover be opened and the fire hose be then connected to the hydrant within the manhole. Accordingly, this hydrant has a problem in rapidly responding to a fire.

Furthermore, in the conventional hydrant system as shown in FIG. 1, a hydrant 101 for supplying water for fire-fighting is disposed within a manhole 103 having a predetermined depth from the surface of the earth 102, which is covered with a manhole cover 112. A water-guide tube 105 is horizontally inserted into the manhole 103 and an opening/shutting valve 105*a* is disposed at the middle portion of the water-guide tube 105. A 90° elbow 106 that is curved vertically to the distal end of the water-guide tube 105 is coupled to a female cylinder 107. A male cylinder 108 has the outer circumference inserted into the inner circumference of the female cylinder 107. A T-shaped coupling pipe 109 is coupled to the top end of the male cylinder 108. A handle 109*a* for drawing the male cylinder 108 over the surface of the earth is formed on the coupling pipe 109.

In this structure, if a user wants to use the hydrant 101, the user holds the handle 109*a* formed on the T-shaped coupling pipe 109 at the top end of the hydrant 101 with hands and draws the handle upwardly. One side of the T-shaped coupling pipe 109 is covered with a cap 110 and the other end of the T-shaped coupling pipe 109 is screwed to a water-supply hose 111 in order to use water for fire-fighting. After the hydrant 101 is used, the opening/shutting valve 105*a* is locked and the water-supply hose 111 is separated from the T-shaped coupling pipe 109. Then, if the handle 109*a* is depressed, the male cylinder 108 returns to its original position due to its weight and the manhole 103 is covered with the manhole cover 112.

As above, if it is desired to use the conventional hydrant 101, the user has to uncover the manhole cover 112 of the hydrant and then draw the male cylinder 108 that is heavy, in a state where the handle 109*a* formed on the T-shaped coupling pipe 109 of the hydrant 101 is held with his or her waist bent. It gives a user inconvenience. Another user must couple the water-supply hose 111 to the drawn T-shaped coupling pipe 109. As such, in order to use the conventional hydrant, at least two persons are required. In order to solve this problem, there was disclosed technology wherein a spring is intervened between the female cylinder 107 and the male cylinder 108 in order to forcibly raise the male cylinder 108 by the resilient force of the spring. This technology is, however, relatively complicated in structure and thus increases the manufacturing cost. Further, since the hydrant is mounted in the underground at the side of a road, there is a problem that the spring may erroneously operate due to vibration of vehicles and moisture.

In addition, in the underground burial-type hydrant, water remaining in the cylinder after water for fire-fighting is used, may freeze in a cold weather. Due to this, in order to anti-freeze the frozen water in an emergency, a thawing device such as an electric resistor has to be used.

DISCLOSURE OF INVENTION

Accordingly, the present invention has been made in order to take advantage of a ground exposure type hydrant and an underground burial type hydrant, and it is an object of the present invention to provide a hydrant system wherein when being used, the hydrant system is projected over the ground, so that the coupling system can be easily coupled to a fire hose, and when not being used, the hydrant system is immersed below the underground, so that damage of the hydrant system is reduced and hindrance of traffic flow is avoided.

Another object of the present invention is to rapidly provide water for fire-fighting without worrying about freezing of a hydrant even in cold weather.

BRIEF DESCRIPTION OF DRAWINGS

Further objects and advantages of the invention can be more fully understood from the following detailed description taken in conjunction with the accompanying drawings in which.

BEST MODE FOR CARRYING OUT THE INVENTION

Embodiment 1

This embodiment refers to the structure of a projection of a coupling element in a hydrant system.

Figure 1:
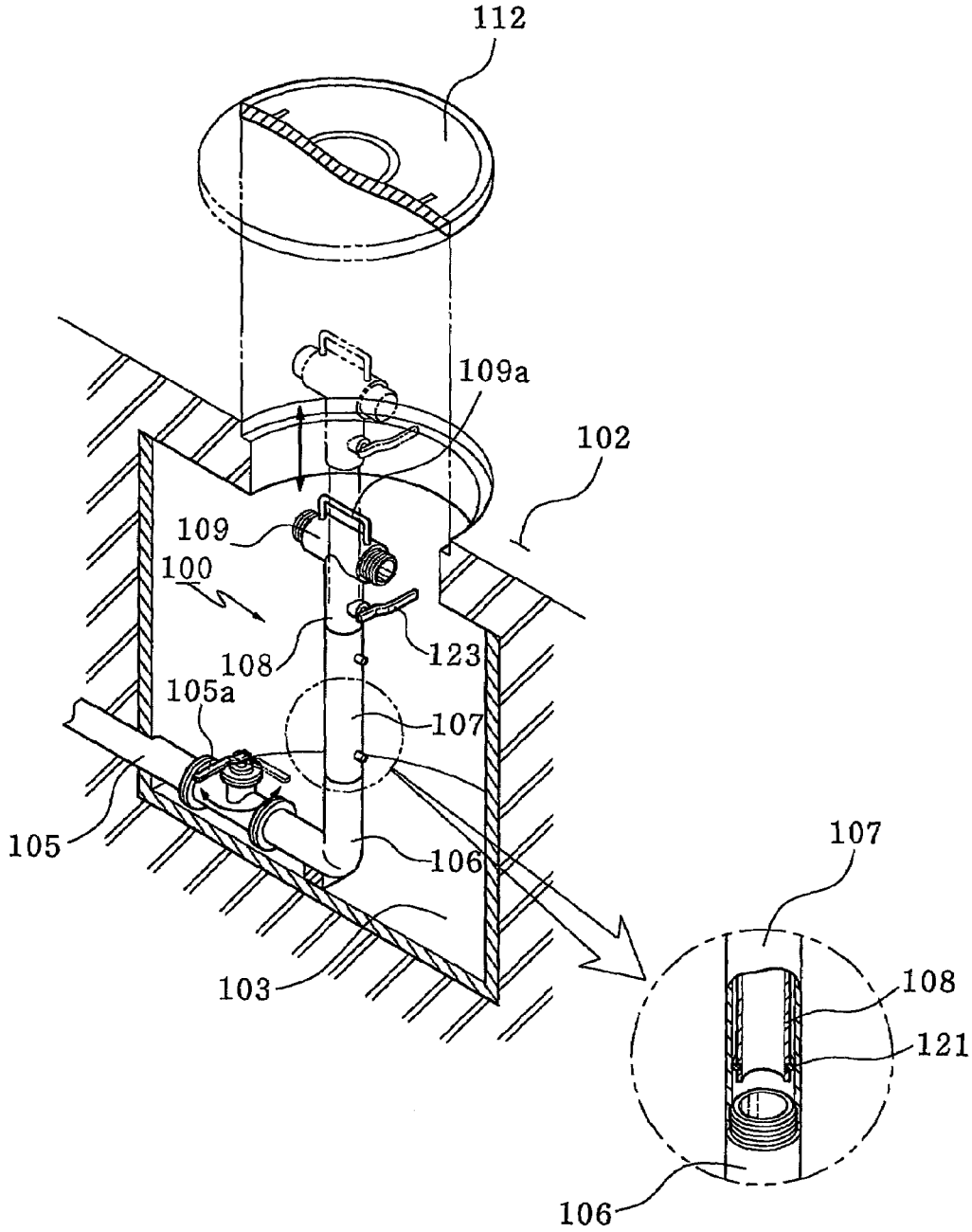
FIG. 1 is a partially cut perspective view illustrating a manhole of a hydrant in which the hydrant is buried in the related art.
Figure 2:
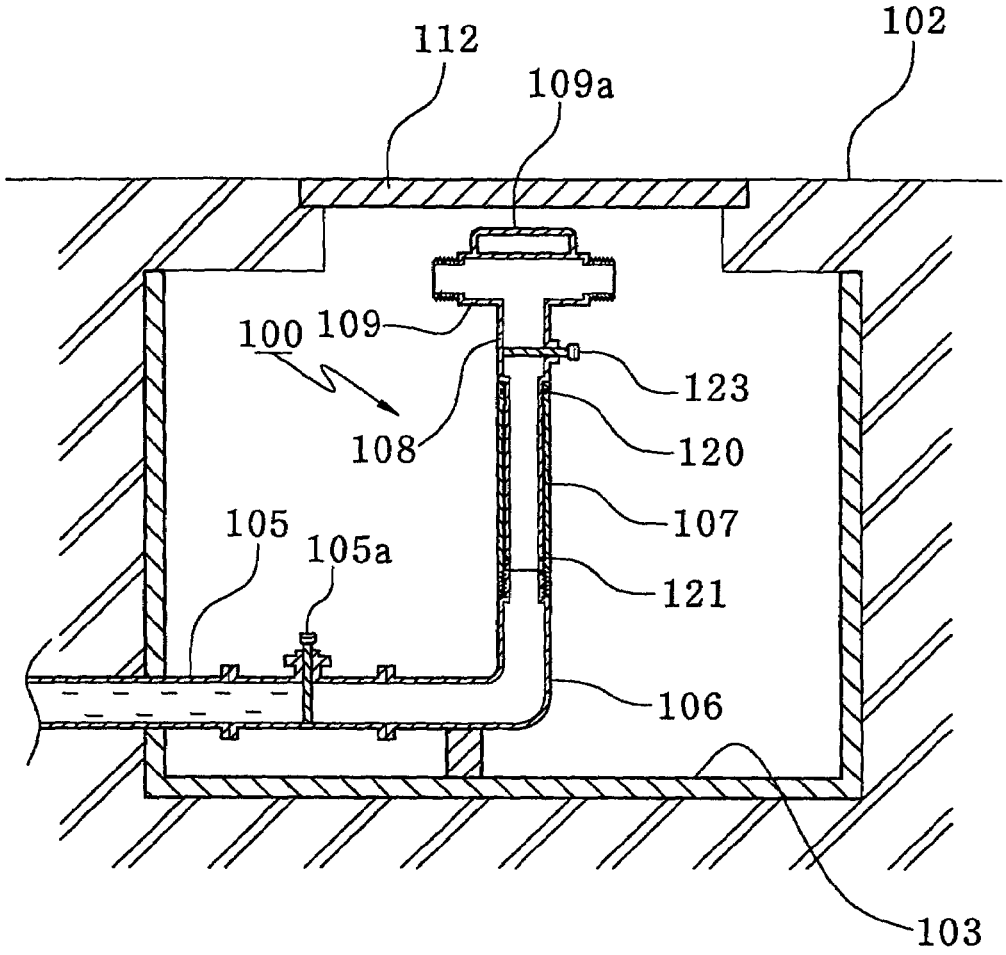
FIG. 2 is a cross-sectional view illustrating a state where a hydrant is buried in a manhole according to a first embodiment of the present invention.
Figure 3:
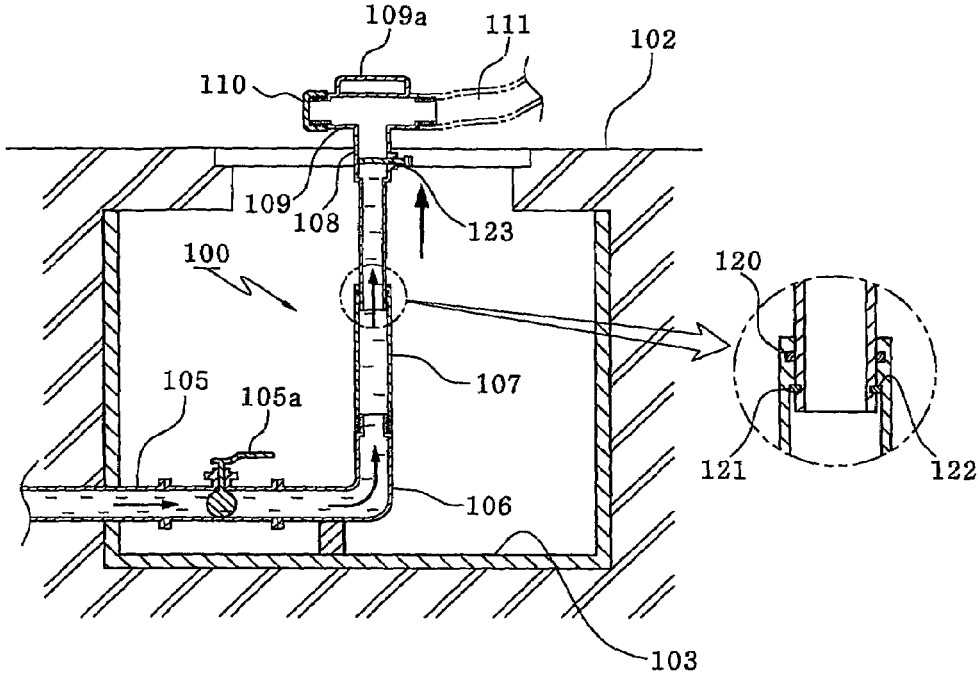
FIG. 3 is a cross-sectional view illustrating a state where a coupler of a cylinder at the top of the hydrant is protruded/exposed toward the top of the manhole by means of the water pressure in the hydrant according to the first embodiment of the present invention.
Figure 4:
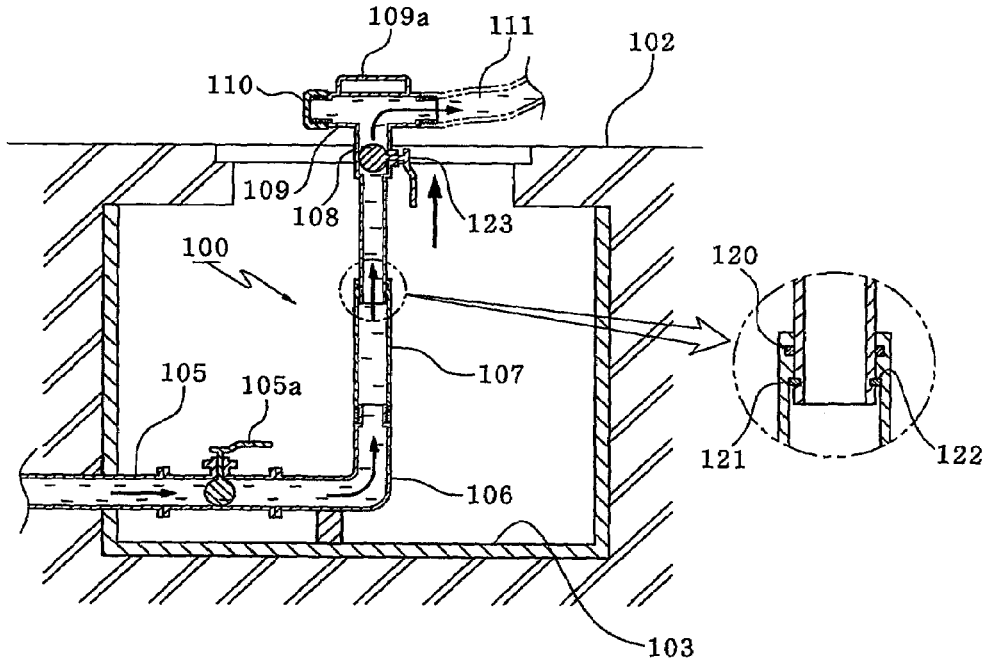
FIG. 4 is a cross-sectional view illustrating a state where water for fire-fighting is introduced into a water-supply hose by opening an opening/shutting valve at the top in FIG. 3.
Figure 5:
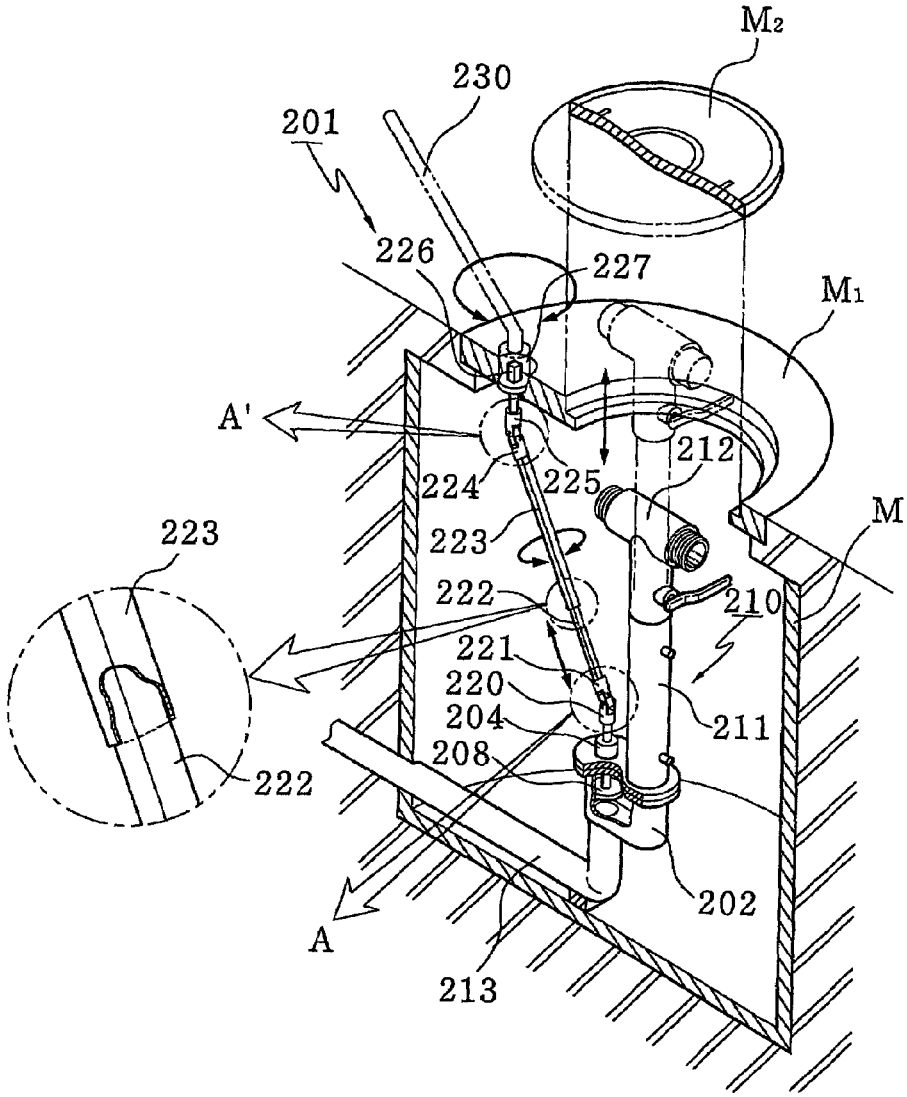
FIG. 5 is a perspective view illustrating a hydrant system in which a manhole of a water-supply valve opening/shutting unit in a hydrant is partially cut according to a second embodiment of the present invention.
Figure 6:
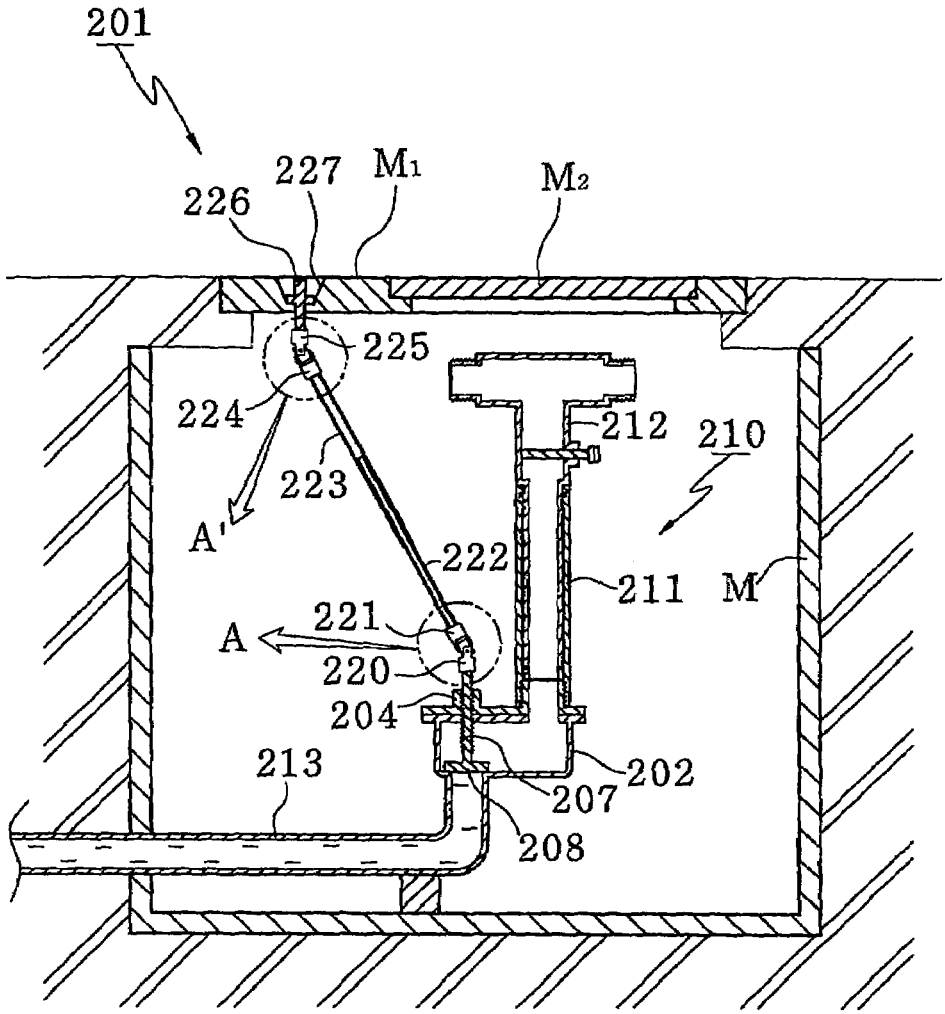
FIG. 6 is a cross-sectional view illustrating the hydrant system before the hydrant is used in the hydrant system according to the first embodiment of the present invention.
Figure 7:
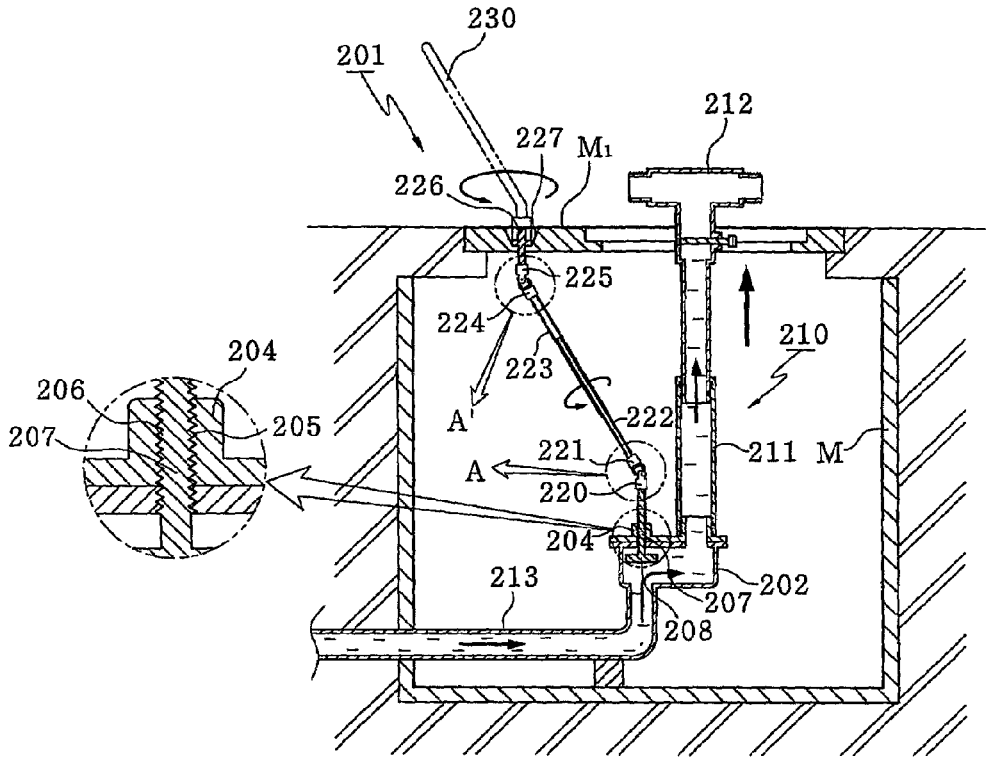
FIG. 7 is a cross-sectional view illustrating a state where the water-supply valve opening/shutting unit is driven to open the water-supply valve in the hydrant system according to the second embodiment of the present invention.
Figure 8:
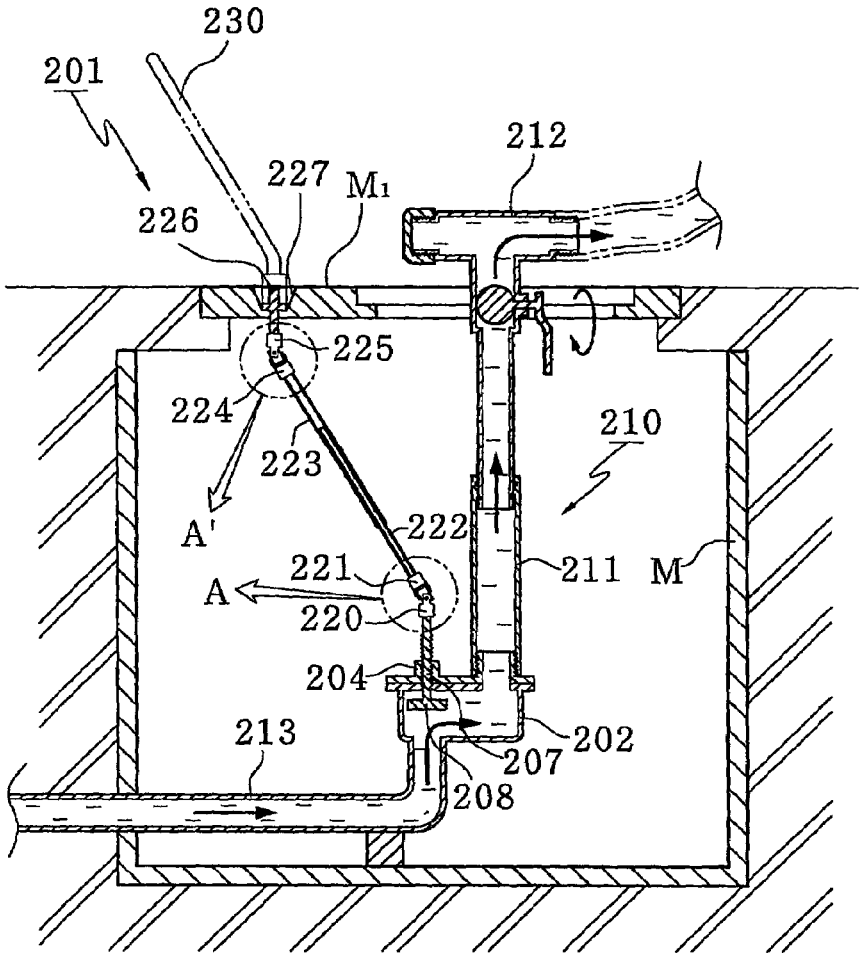
FIG. 8 is a cross-sectional view illustrating a state where an opening/shutting valve is opened to supply water for fire-fighting to a water-supply hose connected to the hydrant in the hydrant system according to the second embodiment of the present invention.
Figure 9:
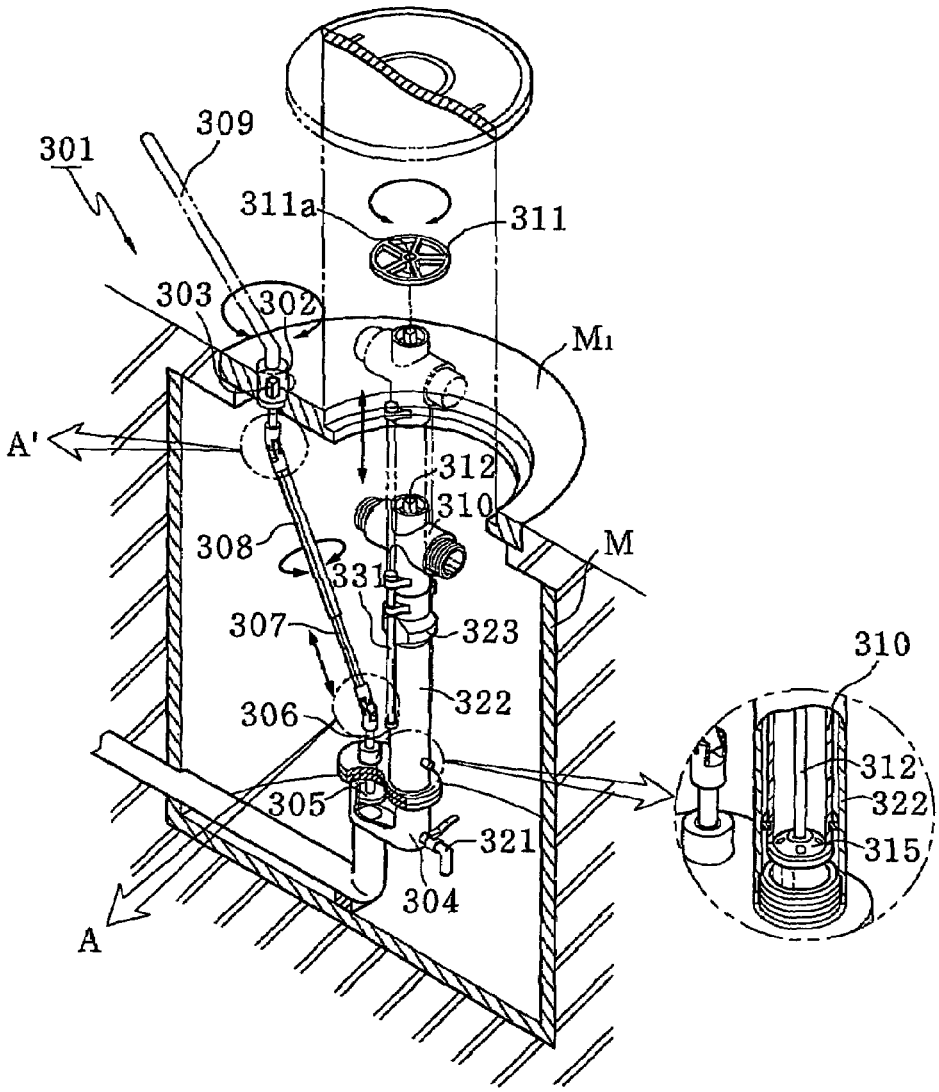
FIG. 9 is a perspective view illustrating a hydrant system in which a manhole of an anti-freezing device in a hydrant is partially cut according to a third embodiment of the present invention.

In the hydrant system described with reference to FIG. 2 through FIG. 4, in a state where a T-shaped coupling pipe 109 that is relatively simple in structure and is coupled to a male cylinder 108 without additional force, is projected over the ground 102, one person can use water for fire-fighting by connecting a water-supply hose 111 to the T-shaped coupling pipe 109. This will now be described in detail with reference to the accompanying drawings.

The hydrant 101 according to the present invention includes a packing element 120 for sealing the outer circumference of the male cylinder 108, which is inserted into the inner circumference of the female cylinder 107 and slides up and down the inner circumference of the female cylinder 107, wherein the packing element 120 is inserted into an upper portion of the inner circumference of the female cylinder 107; a stopper 121 projected at a lower portion of the outer circumference of the male cylinder 108, wherein the stopper 121 is latched at an upper portion of the inner circumference of the female cylinder 107 to form a fixing projection 122 for preventing the male cylinder 108 from rising any further; and an opening/shutting valve 123 mounted in the top of the male cylinder 108.

If it is desired to use the hydrant 101 constructed above, if an opening/shutting valve 105*a* is opened in a state where the opening/shutting valve 123 mounted in the male cylinder 108 is locked, water for fire-fighting of a predetermined water pressure within the water-guide tube 105 is introduced into the male cylinder 108 through the female cylinder 107 and then into the opening/shutting valve 123 mounted at the top of the male cylinder 108. However, since the opening/shutting valve 123 is locked, the water for fire-fighting pushes the opening/shutting valve 123, thereby pushing the male cylinder 108 having the opening/shutting valve 123 mounted therein upwardly. Therefore, the T-shaped coupling pipe 109 connected to the top of the male cylinder 108 is raised on the surface of the earth 102 of the manhole 103. As a result, the stopper 121 at the lower portion of the male cylinder 108 rises until it is latched to the fixing projection 122 of the female cylinder 107 and is not raised further. One person alone can connect the water-supply hose 11 to the raised T-shaped coupling pipe 109. It is also possible to use desired water for fire-fighting by opening only the two opening/shutting valves 105*a* and 123. After the hydrant is used, in a state where the opening/shutting valve 105*a* at the bottom is locked and the opening/shutting valve 123 at the top is opened, if the water-supply hose 111 is separated from the T-shaped coupling pipe 109, the male cylinder 108 is lowered to the bottom of the female cylinder 107 due to its weight to reach its original position. At this time, while the water for fire-fighting remaining in the male cylinder 108 is drained outside the T-shaped coupling pipe 109, the lowering of the male cylinder 108 is completed and the opening/shutting valve 123 mounted in the male cylinder 108 is locked.

Embodiment 2

This embodiment is concerned with a water-supply valve opening/shutting unit in the hydrant system.

Referring to FIG. 5 through FIG. 8, a water-supply valve opening/shutting unit 201 in a hydrant system includes an underground manhole M, a cover plate M1 for shutting the manhole, and a small cover plate M2. The outer circumference of a male cylinder 212 that can move up and down is inserted into the inner circumference of a female cylinder 211 being a cylinder type hydrant 210. The bottom of one side of a water-supply valve 202 to which the female cylinder 211 is coupled has a structure in which the distal end of a water-guide tube 213 introduced from the underground is connected. In the water-supply valve opening/shutting unit 201, the bottom of a cock shaft 207 is connected to an opening/closing packing element 208 to open/shut between the water-guide tube 213 and the water-supply valve 202. A male screw 206 is formed on the outer circumference of the cock shaft 207 that is screwed to a female screw 205 on the inner circumference of a boss 204 that is projected on one side of the water-supply valve 202. The top of the cock shaft 207 is exposed outside the boss 204 and is coupled to a primary shaft 220 of a primary universal joint A. The distal end of a secondary shaft 221 of the universal joint A that is connected to the primary shaft 220 is coupled to a primary bar 222 having a square section. The top end of a secondary bar 223 having a square inner surface into which a square outer surface of the primary bar 222 is inserted by a predetermined length, is coupled to a primary shaft 224 of a secondary universal joint A'. The primary shaft 224 and a secondary shaft 225 of the secondary universal joint A' are coupled to the bottom of a rotating shaft 226 that is vertically formed, wherein the distal end of the secondary shaft 225 is coupled to one side of a hydrant cover plate $M_1$. The top of the rotating shaft 226 has a square cross section and is protruded on a depressed groove 227 formed in the cover plate $M_1$. Thereby, the structure of the water-supply valve opening/shutting unit 201 of the hydrant is completed.

In the drawings, unexplained reference numeral 230 indicates a known T-shaped box spanner. For reference, it is to be noted that the opening/shutting unit 201 may be connected to one sluice packing element, which is one of the known hydrant systems.

As described above, the primary universal joint A, the primary bar 222, the secondary bar 223 and the secondary universal joint A' are organically sequentially connected between the rotating shaft 226 exposed on the depressed groove 227 on the surface of the cover plate M, and the distal end of the cock shaft 207 in which the opening/closing packing element 208 of the water-supply valve 202 is mounted. Thus, without opening the cover plate M1 even if the underground burial type hydrant is located within the manhole M of the underground and the top of the manhole M is covered with the cover plate M1, it is possible to rotate the cock shaft 207 rotatably provided in the water-supply valve 202 in the forward or reverse direction by means of the rotating force even when a rotating shaft line becomes eccentric at a predetermined angle, by rotating the rotating shaft 226 exposed in the depressed groove 227 of the cover plate $M_1$ using the T-shaped box spanner 230. Accordingly, the water-supply valve 202 can be opened/shut, and the primary bar 222 and the secondary bar 223 can be flexibly connected.

Embodiment 3

This embodiment 3 relates to an anti-freezing device of the hydrant system.

Figure 10:
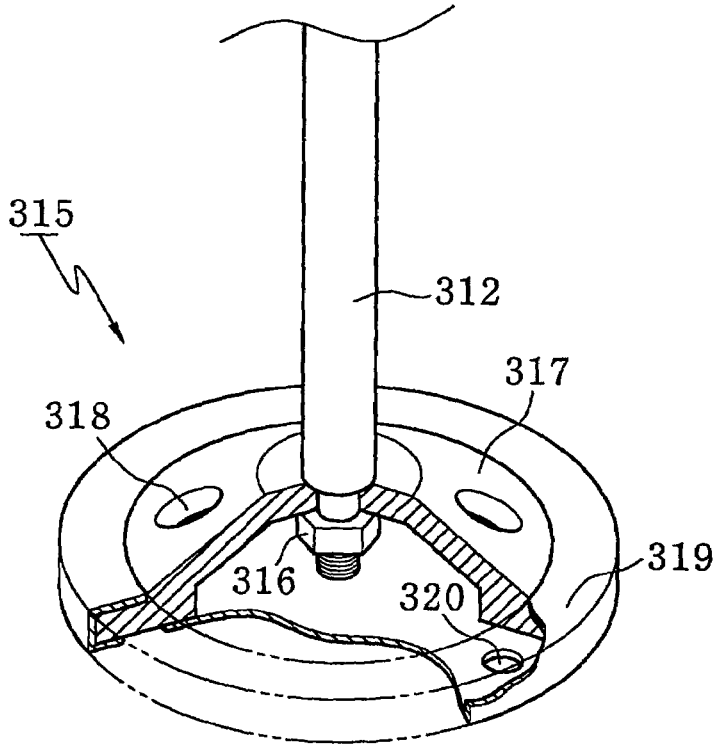
FIG. 10 is a perspective view illustrating a state where the opening/shutting valve is partially cut according to the third embodiment of the present invention.
Figure 11:
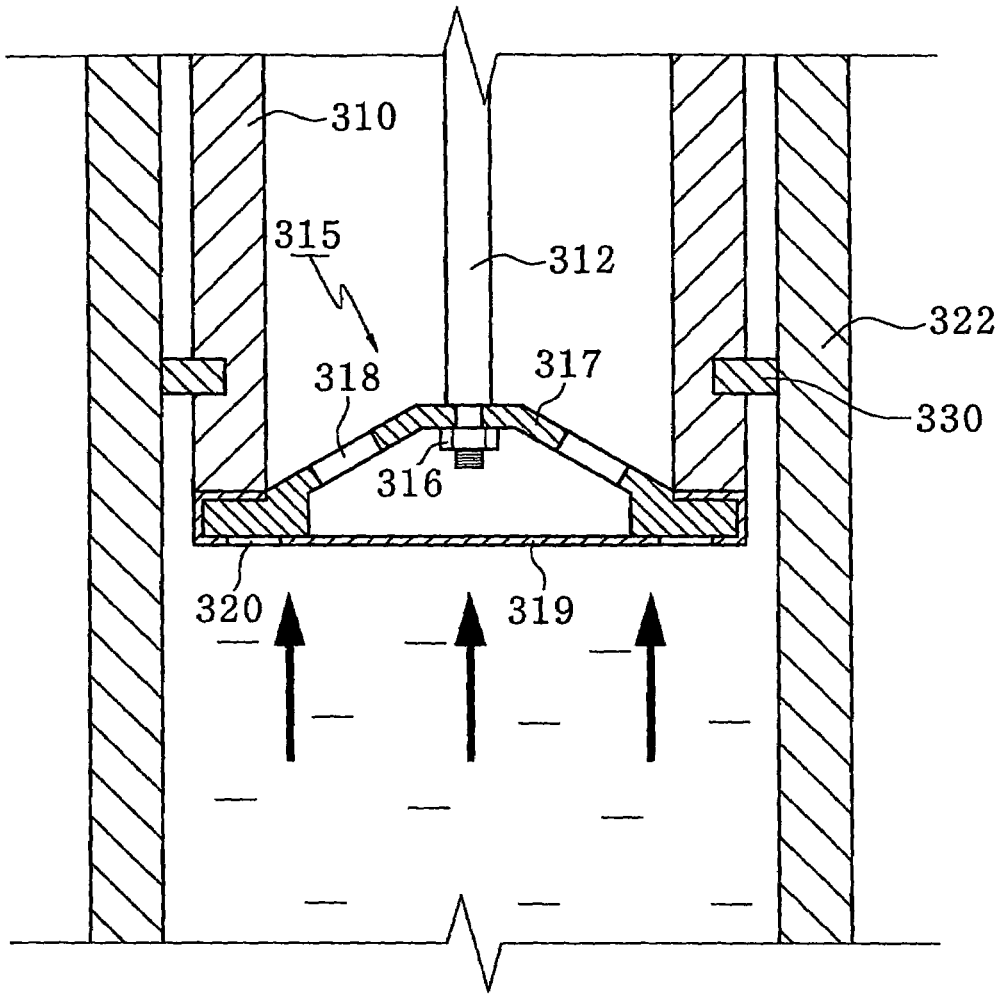
FIG. 11 is a cross-sectional view illustrating a state where the opening/shutting valve is applied with the water pressure from the lower portion according to the third embodiment of the present invention.

Referring to FIG. 9 through FIG. 14, the anti-freezing device serves to prevent water remaining in cylinders 310 and 322 of the hydrant from being frozen due to a cold wave in a cold weather. A square hole 311*a* is formed in the center of a handle 311 at the top of a male cylinder 310 in the hydrant 301 having an anti-freezing function. A vertical rotating shaft 312 having a square head, which is inserted/drawn into/from the square hole 311*a*, is formed in the length direction up to the bottom distal end of the male cylinder. The vertical rotating shaft 312 is matched using a female screw 313 and a male screw 314 so that the vertical rotating shaft 312 can move up and down when the handle 311 is rotated in the forward and backward directions. Furthermore, an opening/shutting valve 315 of a dish shape is fixed to the bottom distal end of the vertical rotating shaft 312 by means of a nut 316. The opening/shutting valve 315 includes water-feeding holes 318 on a dish-shaped body 317 and a rubber covering material 319 having a cross section of ㅌ, wherein the material is covered on the outer circumference of the body 317, as shown in FIG. 10. Furthermore, water-feeding holes 320 are formed at portions where the dish-shaped body 317 and the bottom of the rubber covering material 319 are brought into contact. Therefore, if an opening/closing packing element 305 of a water-supply valve 304 is opened and an opening/shutting valve 315 is pushed upwardly due to the water pressure of water for fire-fighting, the rubber covering material 319 is closely adhered to the dish-shaped body 317 and at the same time causes the male cylinder 310 to protrude over the manhole M, as shown in FIG. 11.

Figure 12:
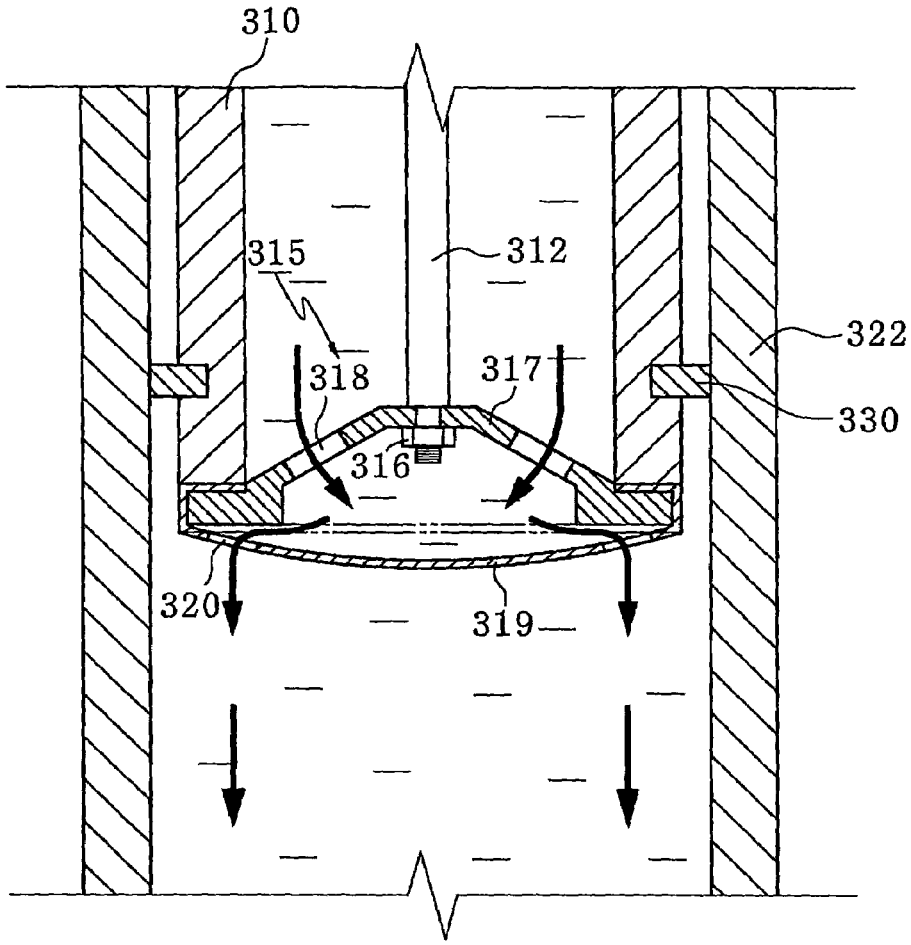
FIG. 12 is a cross-sectional view illustrating a state where water remaining the cylinder is discharged toward the lower portion of the opening/shutting valve according to the third embodiment of the present invention.
Figure 13:
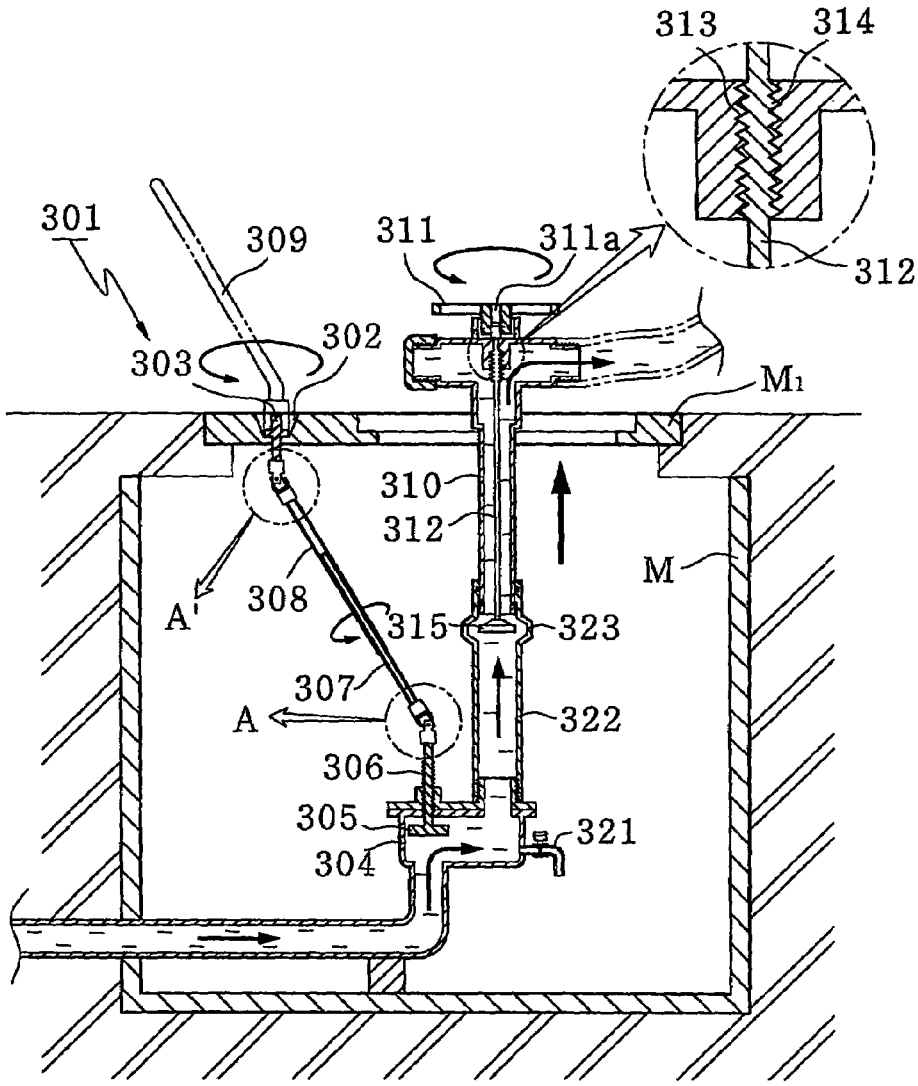
FIG. 13 is a cross-sectional view illustrating a state where the opening/shutting valve is opened to supply water for fire-fighting to a water-supply hose connected to the hydrant according to the third embodiment of the present invention.
Figure 14:
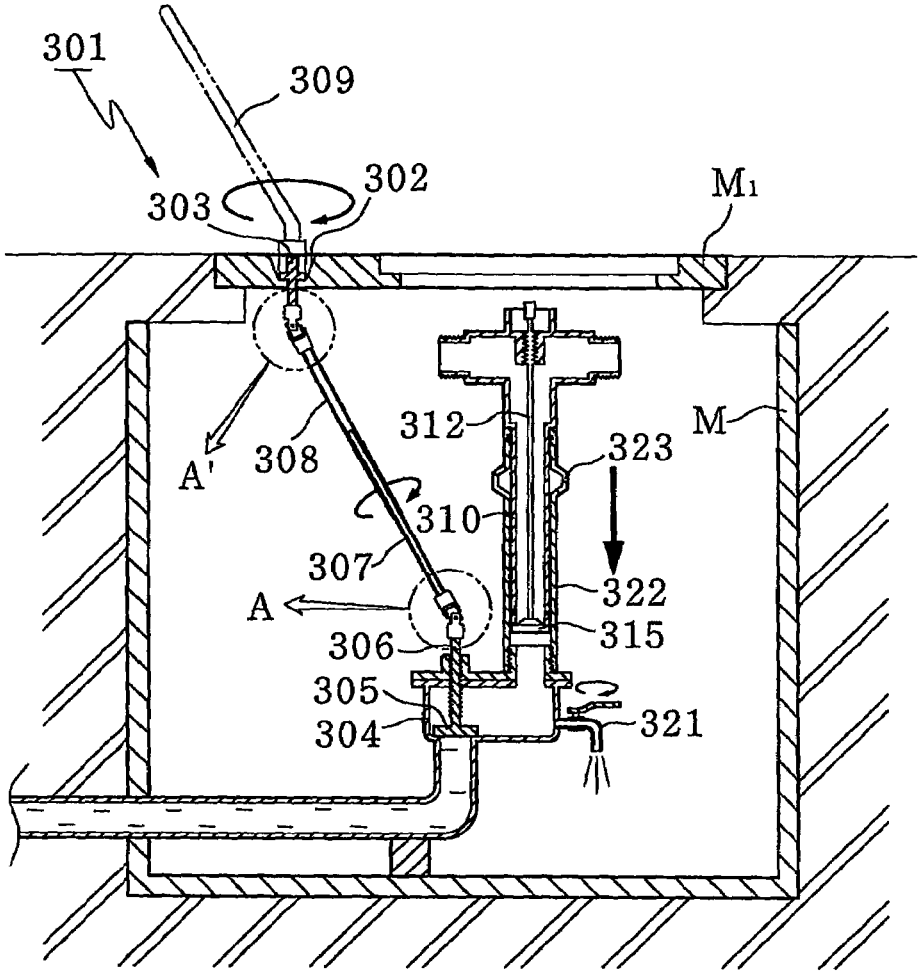
FIG. 14 is a cross-sectional view illustrating a state where after the water-supply valve is shut, a male cylinder is lowered to the bottom of the manhole and water remaining in the cylinder is all discharged through a drain valve according to the third embodiment of the present invention.

Furthermore, if the opening/shutting valve 315 of the male cylinder 310 is shut and the opening/closing packing element 305 of the water-supply valve 304 is shut after water for fire-fighting is used, a drain valve 321 is automatically opened. Thus, water at the upper portion of the opening/shutting valve 315 pushes the rubber covering material 319 out by means of the weight, as shown in FIG. 12. At this time, water that passed through the water-feeding holes 318 of the dish-shaped body 317 between the dish-shaped body 317 and the rubber covering material 319 again flows into the lower portion through the water-feeding holes 320 of the rubber covering material 319 and is then drained through the drain valve 321. As a result, water does not remain in the cylinders 310 and 322.

Next, in the female cylinder 322, a convex room 323 is expanded by a predetermined width and diameter at a place where the opening/shutting valve 315 on the female cylinder 322 is located so that water for fire-fighting can be smoothly supplied when the male cylinder 310 rises up and the opening/shutting valve 315 is opened. In this state, if the opening/shutting valve 315 is lowered, a gap is formed so that water for fire-fighting is dropped between the opening/shutting valve 315 and the female cylinder 322. At the same time, water remaining in the cylinder after the hydrant is used is all drained through the drain valve 321 of the water-supply valve 304, as described above. The structure of the anti-freezing device in the hydrant is thus completed.

In the drawings, unexplained reference numeral 330 indicates a stopper, and 331 indicates a rod that serves as a guide, controls the height and prevents rotation when he male cylinder 310 is raised.

Embodiment 4

This embodiment relates to a hydrant system that is applicable to both the ground exposure type hydrant and the underground burial type hydrant. In this structure, the hydrant is projected over the ground as a sluice valve is opened/shut using a universal joint. As the sluice valve is locked, the hydrant is immersed into the underground and water is automatically drained through the drain valve.

Figure 15:
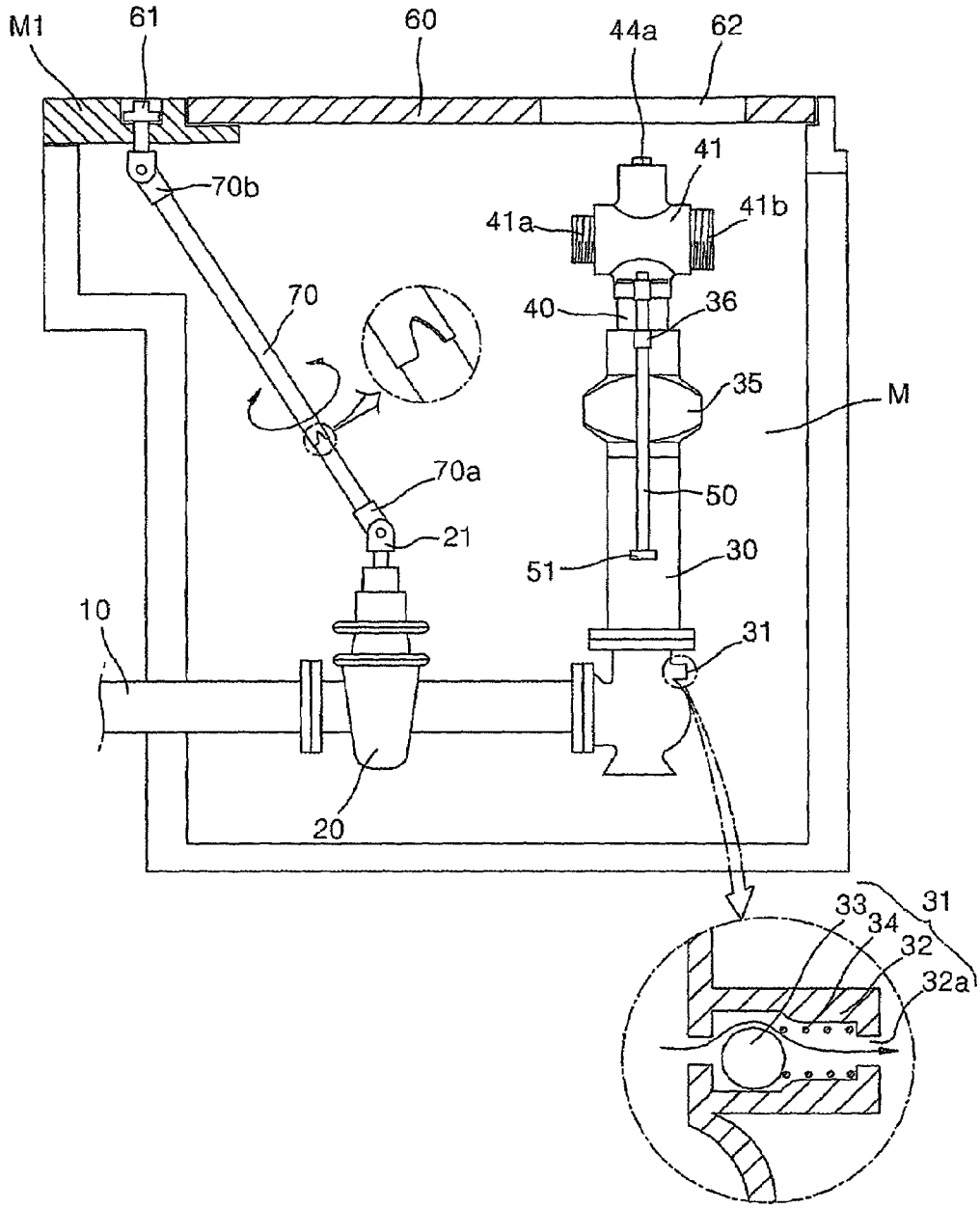
FIG. 15 illustrates the construction of a hydrant system according to a fourth embodiment of the present invention.
Figure 16:
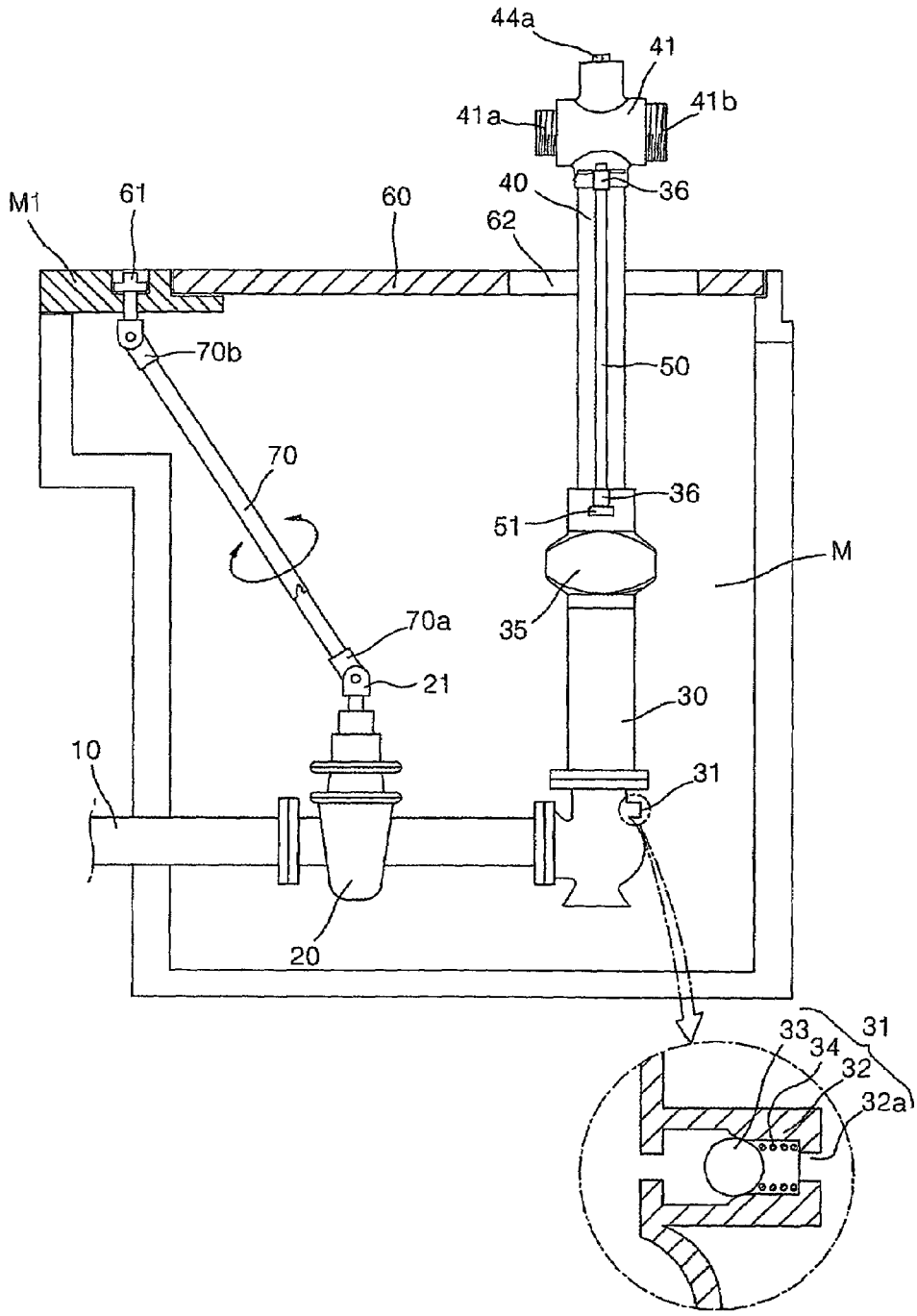
FIG. 16 shows a state where a male cylinder is projected over the ground in the hydrant system shown in FIG. 15.
Figure 17:
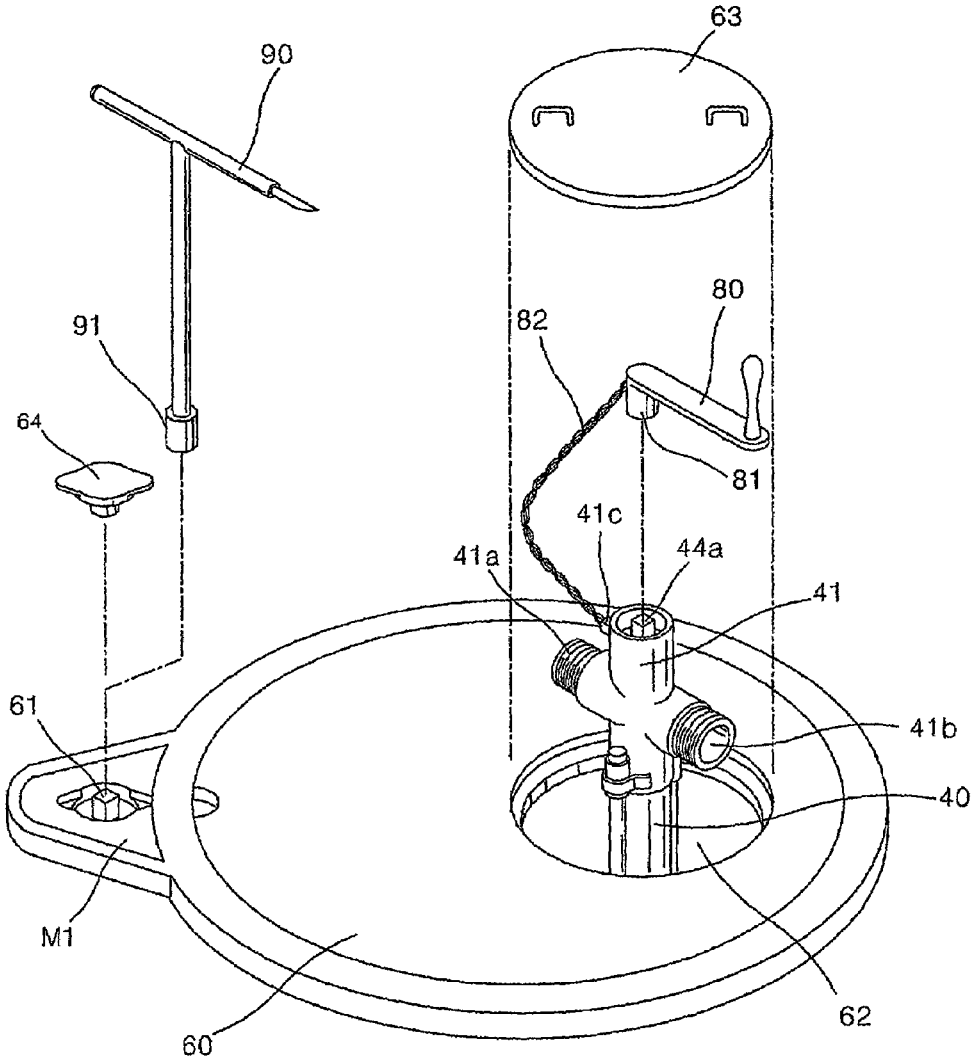
FIG. 17 shows the male cylinder, a manhole cover and a manhole frame extending from the ground in the hydrant system shown in FIG. 16.
Figure 18:
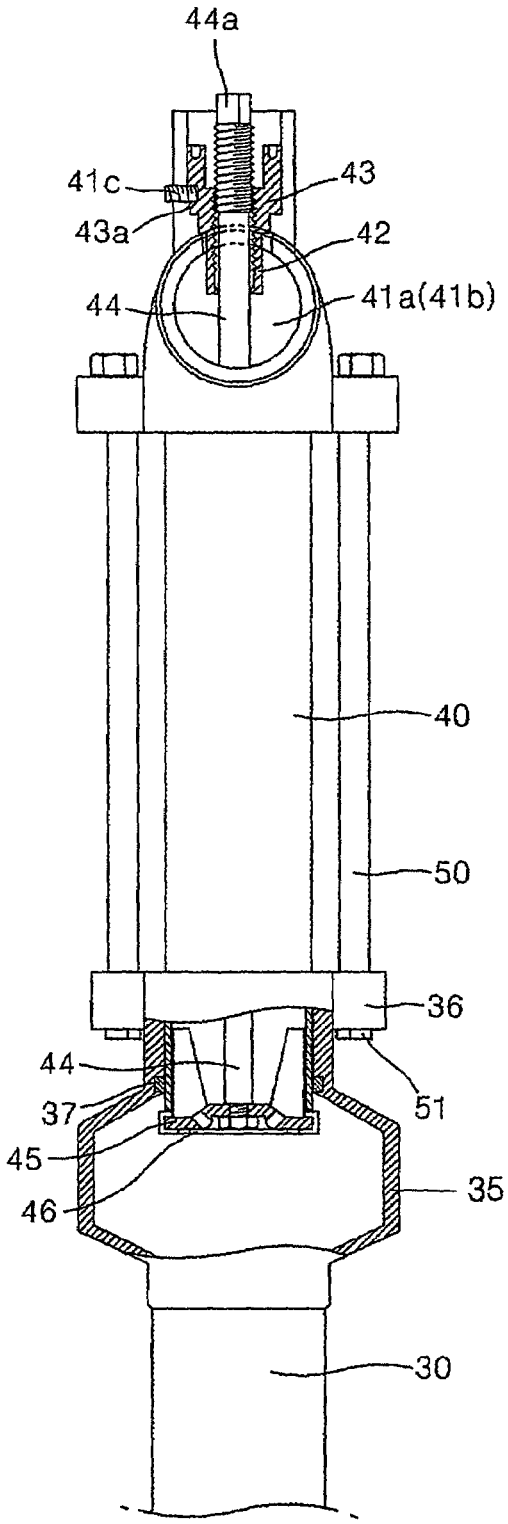
FIG. 18 shows a state where a screw hole bracket, a piston rod and a piston are organically coupled in the hydrant system shown in FIG. 16.
Figure 19:
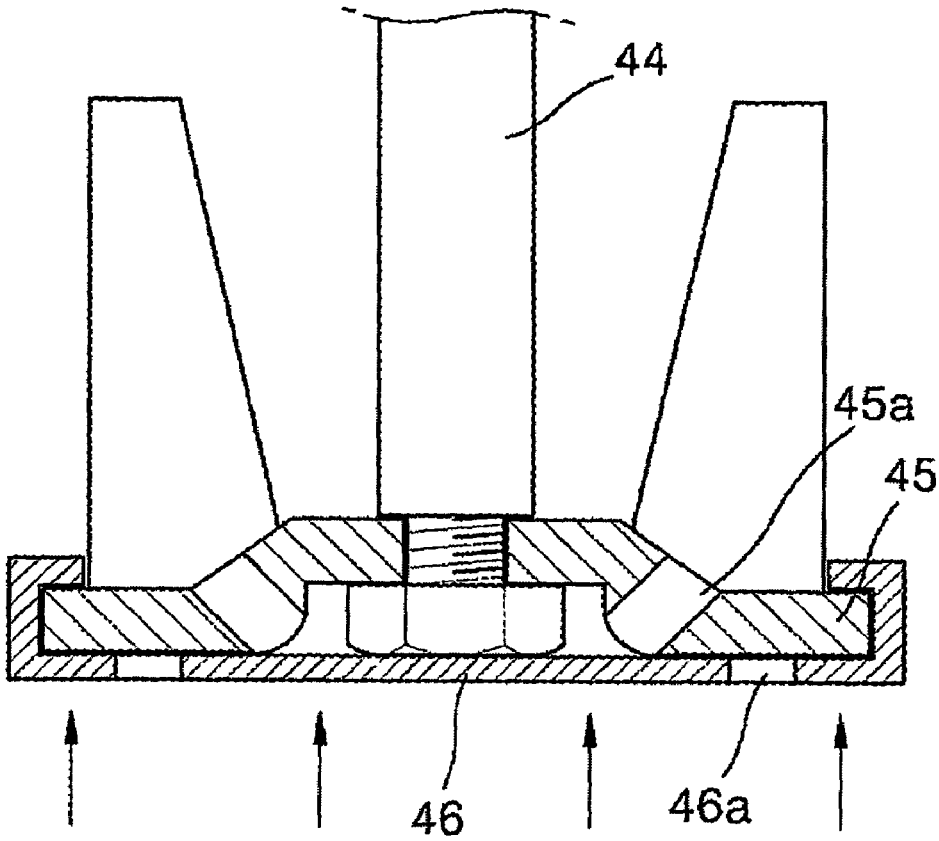
FIG. 19 shows a state where the bottom of the piston cover is closely adhered to the bottom of the piston in the state shown in FIG. 18.
Figure 20:
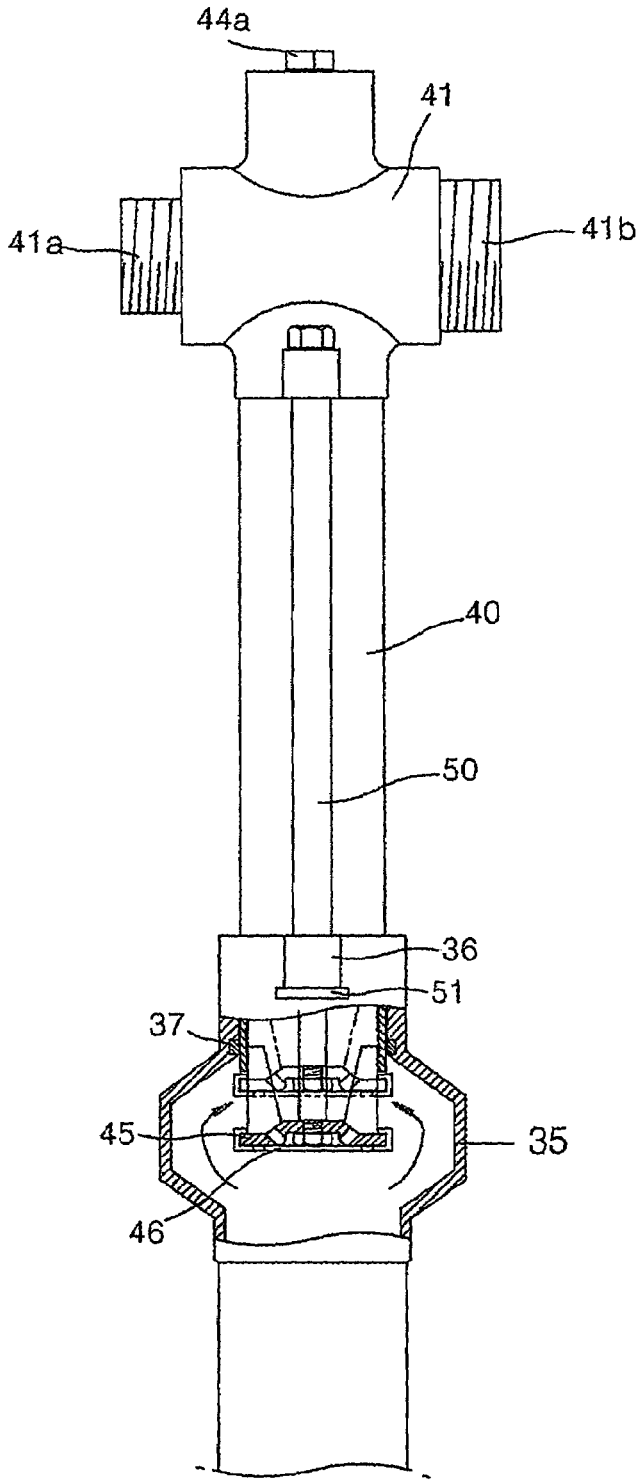
FIG. 20 shows a state where the piston is separated from the end of the male cylinder by rotating the piston rod in the state shown in FIG. 18.
Figure 21:
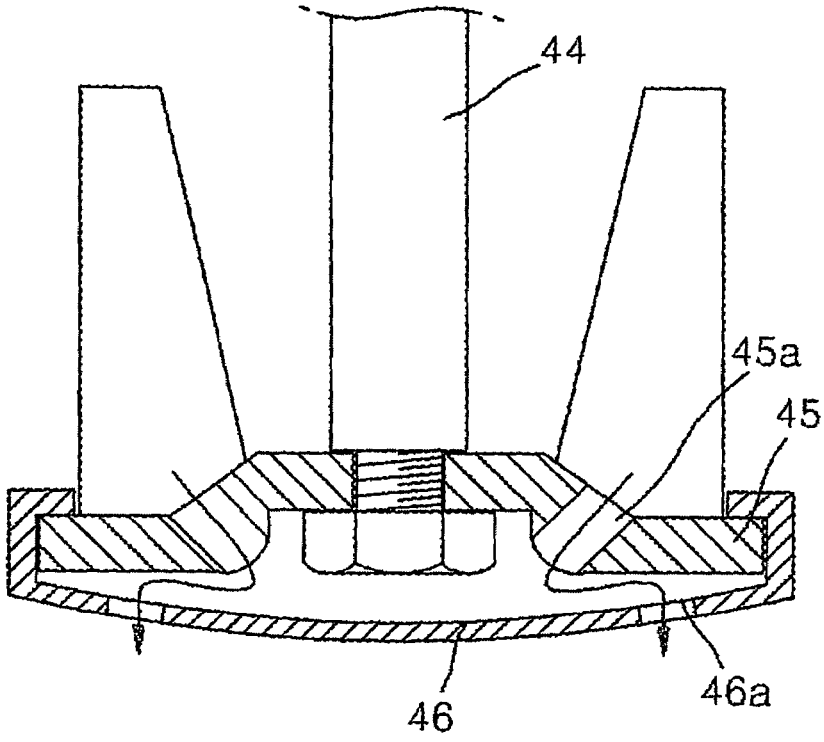
FIG. 21 shows a state where the bottom of the piston cover is separated from the bottom of the piston when the sluice valve is closed in the hydrant system shown in FIG. 16.

FIG. 15 illustrates the construction of a hydrant system according to a fourth embodiment of the present invention, FIG. 16 shows a state where a male cylinder is projected over the ground in the hydrant system shown in FIG. 15, FIG. 17 shows the male cylinder, a manhole cover and a manhole frame when being from the ground in the hydrant system shown in FIG. 16, FIG. 18 shows a state where a screw hole bracket, a piston rod and a piston are organically coupled in the hydrant system shown in FIG. 16, FIG. 19 shows a state where the bottom of the piston cover is closely adhered to the bottom of the piston in the state shown in FIG. 18, FIG. 20 shows a state where the piston is separated from the end of the male cylinder by rotating the piston rod in the state shown in FIG. 18, and FIG. 21 shows a state where the bottom of the piston cover is separated from the bottom of the piston when the sluice valve is closed in the hydrant system shown in FIG. 16.

Referring to FIG. 15 through FIG. 21, the hydrant system according to the present invention includes a sluice valve 20 coupled to a water-guide tube 10 within a manhole M, wherein the sluice valve has a first opening/shutting shaft 21, a hydrant connected to the sluice valve 20, wherein if the sluice valve 20 is opened, the hydrant is projected over the ground and if the sluice valve 20 is locked, the hydrant is immersed into the underground, a manhole cover 60 in which a sub hole 62 through which the hydrant covered with the manhole M passes is formed, a second opening/shutting shaft 61 disposed at a frame M1 of the manhole M or the manhole cover 60, for rotating the first opening/shutting shaft 21, and a universal joint 70 for connecting the first opening/shutting shaft 21 and the second opening/shutting shaft 61, wherein the universal joint is flexible.

The sluice valve 20 serves to supply water for fire-fighting to the hydrant and to prevent water for fire-fighting remaining in the hydrant from flowing backward. Both the sluice valve 20 and the hydrant are disposed within 1 m.

The hydrant mainly includes a female cylinder 30 connected to the sluice valve 20 and standing upright, a male cylinder 40 that pops in and out from the female cylinder 30 and is projected over the ground, and a rod 50 for limiting the projection range of the male cylinder 40 that is projected from the female cylinder 30.

The female cylinder 30 is connected to the sluice valve 20. A drain valve 31, which is opened when the sluice valve 20 is locked and is locked when the sluice valve 20 is opened, is formed at the bottom of the female cylinder 30. The drain valve 31 includes a projection 32 in which an outlet 32*a* protruding from the female cylinder 30 and becoming narrow is formed, a ball 33 built in the projection 32, wherein the ball has a diameter greater than the outlet 32*a*, and a spring 34 for resiliently biasing the ball 33 toward the inside of the female cylinder 30. In this structure, if the sluice valve 20 is opened, the ball 33 clogs the outlet 32*a* by means of the water pressure. If the sluice valve 20 is locked, the outlet 32*a* is opened by the resilient bias of the spring 34 since the water pressure disappears. In this case, water for fire-fighting remaining in the female cylinder 30 is drained to the outside through the outlet 32*a*.

The male cylinder 40 is disposed so that it pops in and out upwardly against the female cylinder 30. A fire-fighting water exhaust unit 41 is formed on the male cylinder 40. Fire-fighting water coupling holes 41*a* and 41*b* connected to a fire hose (not shown) are formed in the fire-fighting water exhaust unit 41. A convex room 35 of a convex structure is formed on the female cylinder 30.

A screw hole bracket 43 having a screw hole 42 formed therein is formed within the male cylinder 40, more particularly, within the fire-fighting water exhaust unit 41, as shown in FIG. 18. At this time, it is preferred that an anti-rotating groove 43*a* to which a clamping bolt 41*c* that passed through the fire-fighting water exhaust unit 41 is connected, is formed so that the screw hole bracket 43 can be firmly fixed to the inside of the fire-fighting water exhaust unit 41.

A piston rod 44 is screwed to the screw hole 42. A valve shaft 44*a* of an angular pole shape is formed on the piston rod 44 and is projected toward the top of the fire-fighting water exhaust unit 41. The bottom of the piston rod 44 is projected toward the bottom of the male cylinder 40 and is coupled to the piston 45.

The valve shaft 44*a* is inserted into a head 81 of a lever spanner 80 and rotates along with the lever spanner 80. At this time, it is preferable that the lever spanner 80 is connected to a chain 82 connected to a clamping bolt 41*c*, as shown in FIG. 17 and FIG. 18. By doing so, the lever spanner 80 is extended within the manhole M when the lever spanner 80 is not used. That is, it is possible to easily use the hydrant system by making the lever spanner 80 always located within the manhole M.

A plurality of first drain holes 45*a* are formed in the piston 45. A piston cover 46 in which a second drain hole 46*a* is formed going amiss with the first drain hole 45*a* is formed in the piston 45 so that the piston cover surrounds the piston 45. In the above, the piston cover 46 is made of a flexible material such as rubber or urethane.

If the piston cover 46 is closely adhered to the piston 45 as shown in FIG. 19, the first drain hole 45*a* and the second drain hole 46*a* are sealed. However, if the piston cover 46 is separated from the piston 45 as shown in FIG. 21, the first drain hole 45*a* and the second drain hole 46*a* are communicating each other.

The rod 50 has one side fixed to the end of the male cylinder 40 and the other side that is slidingly coupled to the through-hole of the bracket 36 formed on the female cylinder 30. At this time, a fixing projection 51 having a diameter greater than the through-hole, for preventing the rod 50 from being deviated from the bracket 36, is formed at the end of the rod 50.

Meanwhile, it is preferred that one or more sealing rings 37 for maintaining the top and bottom sealing in the process in which the male cylinder 40 rises and falls, are formed within the female cylinder 30, as shown in FIG. 18 and FIG. 20.

In this embodiment, the number of the sealing ring adopted is two, but only one is shown in the drawings.

In this structure, as the valve shaft 44*a* rotates in the forward or reverse directions by the lever spanner 80, the piston rod 44 rises against the screw hole bracket 43. Accordingly, the edge of the piston cover 46 surrounding the piston 45 is closely adhered/separated to/from the bottom of the male cylinder 40. That is, if the valve shaft 44*a* rotates in the forward direction, the piston rod 44 rises and the edge of the piston cover 46 is closely adhered to the bottom of the male cylinder 40, as shown in FIG. 18. Resultantly, the male cylinder 40 is closed. On the contrary, if the valve shaft 44*a* rotates in the reverse direction, the piston rod 44 falls and the edge of the piston cover 46 is separated from the bottom of the male cylinder 40, as shown in FIG. 20. As a result, the male cylinder 40 is opened.

There are shown in FIG. 15 through FIG. 17 that the second opening/shutting shaft 61 is disposed in a manhole cover 60 or a manhole frame M1, and the sub hole 62 through which the male cylinder 40 is projected is formed in the manhole cover 60 or the manhole frame M1. In this embodiment, however, the second opening/shutting shaft 61 is disposed on the manhole frame M1. In the above, the end of the second opening/shutting shaft 61 has a square and is inserted into a head 91 of a known T-shaped spanner 90 so that it rotates together with the T-shaped spanner 90. At this time, the end of the second opening/shutting shaft 61 is covered with an opening/shutting cover 64 when not being used. If the male cylinder 40 is immersed into the female cylinder 30 and is then located under the underground, a sub hole cover 63 for shutting that sub hole 62 is inserted into the sub hole 62.

The universal joint 70 serves to transfer the rotating force of the second opening/shutting shaft 61 to the first opening/shutting shaft 21 even when the first opening/shutting shaft 21 of the sluice valve 20 and the second opening/shutting shaft 61 of the manhole cover 60 go amiss. Such a universal joint 70 is connected to the first opening/shutting shaft 21 and the second opening/shutting shaft 61 by means of first and second joints 70*a* and 70*b*, respectively. The universal joint 70 is constructed to be flexible so that it can be freely used regardless of the distance between the first opening/shutting shaft 21 and the second opening/shutting shaft 61. The operation of the hydrant system constructed above will now be described.

If the head 91 of the T-shaped spanner 90 is inserted into the second opening/shutting shaft 61 and is then rotated, the first opening/shutting shaft 21 of the sluice valve 20 is rotated by the universal joint 70. The sluice valve 20 is thus opened. Then, water for fire-fighting introduced from the water-guide tube 10 is introduced into the female cylinder 30 through the sluice valve 20. The male cylinder 40 shut by the piston 45 is raised by the pressure of the introduced water as shown in FIG. 2. The raised male cylinder 40 is projected over the ground through the sub hole 62 of the manhole cover 60, and the fire-fighting water coupling holes 41*a* and 41*b* formed on the male cylinder 40 are exposed on the ground. Therefore, a fire-fighting hose can be easily coupled to the fire-fighting water coupling holes 41*a* and 41*b*.

In this state, the head 81 of the lever spanner 80 is coupled to the valve shaft 44*a* exposed toward the top of the fire-fighting water exhaust unit 41 and is then rotated. Then, as shown in FIG. 20, as the piston 45 moves downwardly, the male cylinder is opened while the piston cover 46 surrounding the piston 45 is separated from the end of the male cylinder 40. Next, water for fire-fighting through the sluice valve 20 is drained to the fire-fighting water coupling holes 41*a* and 41*b* between the convex room 35 and the male cylinder 40. The water for fire-fighting drained to the fire-fighting water coupling holes 41*a* and 41*b* can be used to extinguish a fire through a fire-fighting hose connected to the fire-fighting water coupling holes 41*a* and 41*b*.

In order to prevent water for fire-fighting from draining, the valve shaft 44*a* is rotated in the reverse direction to raise the piston rod 44 upwardly. The piston cover 46 surrounding the piston 45 is then closely adhered to the end of the male cylinder 40, thereby shutting the male cylinder 40.

In this state, if the first opening/shutting shaft 21 in the sluice valve 20 is rotated in the reverse direction to lock the sluice valve 20, the water pressure disappears. Therefore, the outlet 32*a* is opened by a resilient bias of the spring 34 and water for fire-fighting remaining in the female cylinder 30 is drained to the outside through the outlet 32*a*. Due to this, the male cylinder slowly falls.

Meanwhile, if the water pressure within the female cylinder disappears, the bottom of the piston cover 46 is separated from the bottom of the piston 45, and the first drain hole 45*a* and the second drain hole 46*a* are brought into communication, as shown in FIG. 21. Thus, water for fire-fighting remaining in the male cylinder 40 is discharged to the female cylinder. As a result, water for fire-fighting within the male cylinder 40 is completely empty, thus preventing the hydrant from being frozen.

INDUSTRIAL APPLICABILITY

As described above, according to a hydrant system of the present invention, a male cylinder is raised and lowered through only the operation of opening and shutting two opening/shutting valves using the water pressure without additional device. Therefore, since the hydrant is projected over the ground when being used, it is possible to easily connect a fire hose to the hydrant. Also, since the hydrant is immersed into a manhole when not being used, it is possible to prevent the hydrant from being damaged due to collision of a vehicle, etc. and from hindering traffic flow.

Furthermore, according to the present invention, regardless of positional error of a rotating shaft and a cock shaft, the cock shaft is rotated in the forward or reverse direction. Thus, water for fire-fighting can be supplied to the hydrant rapidly and simply without the need for opening a manhole cover by a worker. Accordingly, the present invention has an effect that it can extinguish a fire more rapidly.

In addition, according to the present invention, after water for fire-fighting is used, water remaining in a cylinder is all discharged through a drain valve. It is thus possible to obviate inconvenience that a user has to melt a hydrant frozen in a cold weather by using an anti-freezing device such as an electric resistor. The present invention has an effect that it can rapidly extinguish a fire in the cold without worrying about the freezing of the hydrant.

The invention claimed is:

1. A hydrant system for supplying water for fire-fighting to extinguish a fire, wherein the hydrant system is buried in an underground manhole, comprising:

a packing element for sealing the outer circumference of a male cylinder, which is inserted into the inner circumference of a female cylinder and slides up and down the inner circumference of the female cylinder, wherein the packing element is inserted into an upper portion of the inner circumference of the female cylinder;

a stopper projected at a lower portion of the outer circumference of the male cylinder, wherein the stopper is latched to an upper portion of the inner circumference of the female cylinder to form a fixing projection for preventing the male cylinder from rising any further; and an opening/shutting valve mounted in the top of the male cylinder.

2. A hydrant system having a water-supply valve opening/shutting unit, comprising:

cock shaft having a bottom connected to an opening/closing packing element, thus opening/shutting between a water-guide tube and a water-supply valve;

a male screw formed on the outer circumference of a cock shaft that is screwed to a female screw on the inner circumference of a boss, wherein the boss is projected on one side of the water-supply valve and wherein the top of the cock shaft is exposed outside the boss and is coupled to a primary shaft of a primary universal joint A;

a secondary shaft of the universal joint A having a distal end coupled to a primary bar having a square section, wherein the secondary shaft is connected to the primary shaft;

a secondary bar having a top end and coupled to a primary shaft of a secondary universal joint A', wherein the top end of the secondary bar has a square inner surface into which a square outer surface of the primary bar is inserted by a predetermined length; and a rotating shaft that is vertically formed and has a bottom to which the primary shaft and a secondary shaft of the secondary universal joint A' are coupled, wherein the distal end of the secondary shaft is coupled to one side of a hydrant cover plate M1, wherein the top of the rotating shaft has a square cross section and is protruded on a depressed groove formed in the cover plate M1.

3. A hydrant system having an anti-freezing device, comprising:

a vertical rotating shaft having a square head and formed on a male cylinder in the length direction up to a bottom distal end of the male cylinder, wherein the vertical rotating shaft and the male cylinder are matched using a female screw and a male screw;

an opening/shutting valve of a dish shape, which is fixed to the bottom distal end of the vertical rotating shaft by means of a nut, wherein the opening/shutting valve comprises water-feeding holes on a dish-shaped body and a rubber covering material having a cross section of ㄷ, wherein the material is covered on the outer circumference of the body;

water-feeding holes formed at portions where the dish-shaped body and the bottom of the rubber covering material are brought into contact;

a female cylinder having a convex room of predetermined width and diameter at a place where the opening/shutting valve on the female cylinder is located; and a drain valve disposed in a water-supply valve.

4. A hydrant system, comprising:

a sluice valve connected to a water-guide tube within a manhole M, the sluice valve having a first opening/shutting shaft disposed therein;

a female cylinder connected to the sluice valve and standing upright, wherein the female cylinder includes a drain valve that is opened when the sluice valve is locked and that is locked when the sluice valve is opened, and a bracket formed thereon, the bracket having a through-hole;

a male cylinder disposed to pop in and out upwardly against the female cylinder, wherein the male cylinder includes a fire-fighting water exhaust unit connected to a fire hose thereon, a screw hole bracket disposed within the fire-fighting water exhaust unit, wherein the screw hole bracket has a screw hole formed therein, a piston rod screwed to the screw hole, and a piston disposed at the bottom of the piston rod, wherein the piston opens and shuts the bottom of the male cylinder as the piston rod is rotated in the forward or reverse direction;

a rod for limiting a projection range of the male cylinder protruded from the female cylinder, wherein the rod has one side fixed to the top of the male cylinder and the other side slidingly inserted into the through-hole of the bracket, and wherein the rod has a fixing projection of a diameter greater than the through-hole so that the projection is not deviated from the bracket;

a manhole cover that covers the manhole M, wherein the manhole cover has a sub hole through which the male cylinder passes;

a second opening/shutting shaft disposed at a frame M1 of the manhole M or the manhole cover, for rotating the first opening/shutting shaft; and a universal joint being flexible, for coupling the first opening/shutting shaft and the second opening/shutting shaft.

5. The hydrant system as claimed in claim 4, wherein the drain valve comprises:

a projection in which an outlet protruding from the female cylinder and becoming narrow is formed;

a ball built in the projection, wherein the ball has a diameter greater than the outlet; and a spring for resiliently biasing the ball toward the inside of the female cylinder.

6. The hydrant system as claimed in claim 4, wherein a convex room of a convex structure is formed on the female cylinder.

* * * * *